US006976713B2

(12) United States Patent
Kish et al.

(10) Patent No.: US 6,976,713 B2
(45) Date of Patent: Dec. 20, 2005

(54) APPARATUS FOR USE IN APPLYING GRANULAR MATERIAL TO A RAIL

(76) Inventors: Tom Kish, 4311 Plover Ave., Stow, OH (US) 44224; Peter Pietrowski, Kolberger Str. 40, D-45770 Marl (NO)

( * ) Notice: Subject to any disclaimer, the term of this patent is extended or adjusted under 35 U.S.C. 154(b) by 229 days.

(21) Appl. No.: 10/368,105

(22) Filed: Feb. 18, 2003

(65) Prior Publication Data

US 2004/0160064 A1 Aug. 19, 2004

(51) Int. Cl.[7] ..... B60B 39/00

(52) U.S. Cl. ..... 291/24; 291/3; 291/38; 222/72

(58) Field of Search ..... 291/38, 46, 25, 291/30, 41, 3, 24; 239/654, 656; 222/72, 222/146.6, 146.5, 146.2, 204, 331

(56) References Cited

U.S. PATENT DOCUMENTS

| | | | | |
|---|---|---|---|---|
| 77,602 A | | 5/1868 | Floyd | |
| 490,269 A | | 1/1893 | Chisholm | |
| 893,878 A | | 7/1908 | Shires | |
| 1,735,097 A | | 11/1929 | Vissering | |
| 1,824,067 A | | 9/1931 | Becker | |
| 2,597,719 A | | 5/1952 | Foster | |
| 2,890,970 A | | 6/1959 | Allen | |
| 3,123,386 A | | 3/1964 | Frantz | |
| 3,617,079 A | | 11/1971 | Bente | |
| 4,059,134 A | | 11/1977 | Vilette | |
| 4,215,824 A | * | 8/1980 | Weiste | 239/655 |
| 4,224,968 A | | 9/1980 | Bosser et al. | |
| 4,230,045 A | | 10/1980 | Fearon | |
| 4,325,573 A | | 4/1982 | Hefter et al. | |
| 4,381,898 A | * | 5/1983 | Rotolico et al. | 406/118 |
| 4,747,627 A | | 5/1988 | Shigeura et al. | |
| 4,815,414 A | * | 3/1989 | Duffy et al. | 118/308 |
| 4,968,069 A | | 11/1990 | Jensen | |
| 5,412,910 A | * | 5/1995 | Woodson et al. | 451/38 |
| 5,558,474 A | * | 9/1996 | Wildon | 406/127 |
| 5,687,814 A | | 11/1997 | Craig et al. | |
| 5,931,393 A | * | 8/1999 | Alsip et al. | 239/654 |

FOREIGN PATENT DOCUMENTS

| | | | | |
|---|---|---|---|---|
| DE | 2025039 | | 5/1970 | |
| DE | 2241534 | | 3/1974 | |
| DE | 102524661 | | 11/2002 | |
| GB | 2205573 A | * | 12/1988 | C08L 95/00 |

* cited by examiner

*Primary Examiner*—Frantz F. Jules
(74) *Attorney, Agent, or Firm*—Tarolli, Sundheim, Covell & Tummino L.L.P.

(57) ABSTRACT

An apparatus for applying granular material to a rail adjacent to a wheel of a train includes a granular supply material container to which a granular material injection assembly is connected. The granular material injection assembly includes a housing having a mixing chamber. An insert is connected with the housing. A first end portion of the insert has an air inlet through which air flows into the mixing chamber. A second end portion of the insert has an air outlet through which air and granular material flow from the mixing chamber. A valve may be mounted in the air inlet portion of the insert. A venturi may be mounted in the air outlet portion of the insert. A deflector portion of the insert deflects granular material away from a path of flow of air between the air inlet and the air and granular material outlet.

34 Claims, 6 Drawing Sheets

APPARATUS FOR USE IN APPLYING GRANULAR MATERIAL TO A RAIL

BACKGROUND OF THE INVENTION

During operation of light and/or heavy trains, it may be desirable to increase traction between a wheel of the train and a rail. An improved apparatus is provided to apply granular material, such as sand, quartz, or other particles, to a rail to increase traction between the rail and a wheel of the train. Known devices for applying granular material to a rail adjacent to a wheel of a train are disclosed in U.S. Pat. Nos. 3,617,079; 4,325,573; and 4,747,627.

SUMMARY OF THE INVENTION

An improved apparatus for use in applying granular material to a rail adjacent to a wheel of a train includes a container which holds a supply of granular material. The granular material flows from the container to a mixing chamber. Air is conducted to the mixing chamber through an air inlet. Air and granular are conducted from the mixing chamber through an outlet.

A venturi may advantageously be provided in the air and granular material outlet to induce an upward flow of granular material from a lower portion of the mixing chamber toward the air and granular material outlet. A deflector may be provided to deflect a flow of granular material entering the mixing chamber away from a flow of air from the air inlet. A valve may be provided to facilitate controlling the rate of flow of air into the mixing chamber. To facilitate assembly and maintenance, it may be desired to have the valve, the deflector, and the venturi form a separate assembly which can be positioned in a housing for the mixing chamber.

In order to promote the application of granular material at a desired rate to the rail, the rate of flow of air to the mixing chamber may be varied as a function of variations in speed of the train. This may be accomplished by effecting operation of a compressor drive motor at a speed which is a function of the speed of the train. This results in the compressor supplying air to the mixing chamber at a flow rate which varies as a function of variations in the speed of the train. If desired, the valve may be actuated to vary the rate of flow of air to the mixing chamber.

The present invention has many different features. Each of these features may be used separately or in combination with other features of the invention. If desired, one or more of the features of the present invention may be combined with features of the prior art.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
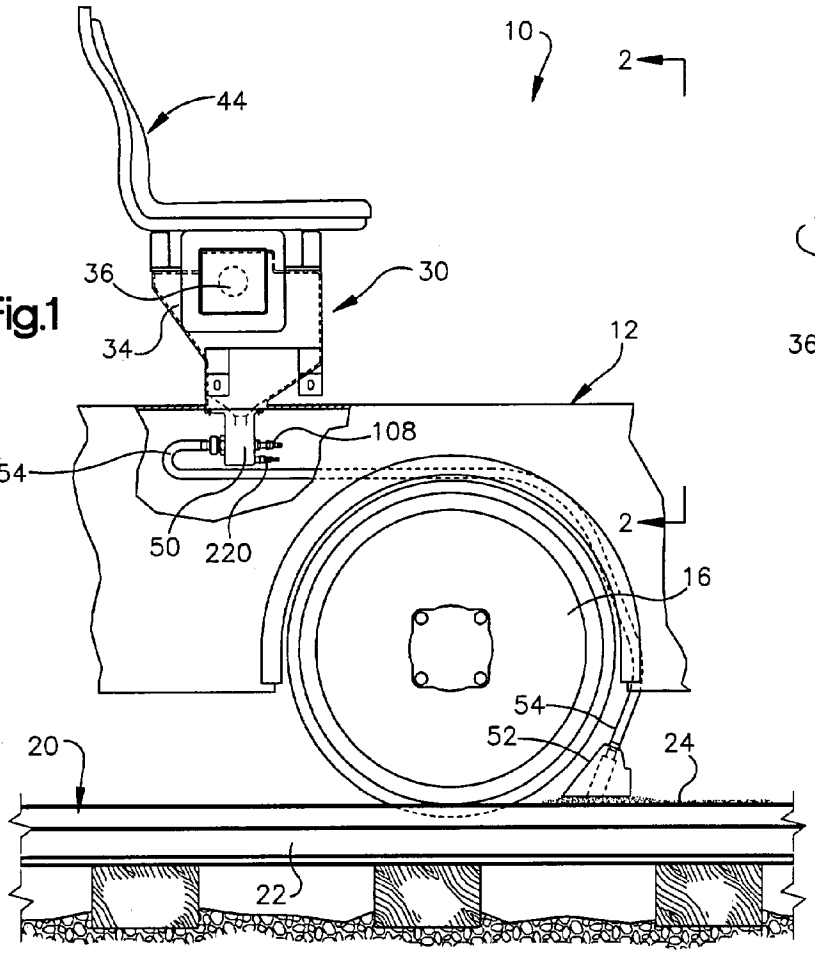
FIG. 1 is a fragmentary schematic illustration depicting the relationship between an apparatus for use in applying granular material to a rail and a portion of a car of a train.

A train 10 is illustrated schematically in FIG. 1. The train 10 may have one or more cars 12. The train 10 may be a light rail train. If the train 10 is a light rail train, the car 12 may be a tram, trolley, street car, or other type of light rail car.

The car 12 has a truck or bogie (not shown) on which a wheel 16 is rotatably mounted. The wheel 16 is a steel wheel. However, the wheel 16 may be provided with a rubber tire. The truck is movable relative to the car 12 to enable the wheel 16 to turn as the train 10 proceeds along curved sections of a track 20.

The track 20 includes a plurality of rails which are interconnected by ties and fasteners. One rail 22 of the track 20 is illustrated in FIG. 1. The rails 22 of the track 20 are formed of steel and have treads or top surfaces 24 which are engaged by the wheels 16.

During operation of the train 10, conditions between the wheel 16 and rail 22 may be such that the wheel tends to slip relative to the rail 22 during braking and/or acceleration of the train. These conditions may include spin-slide (slip-slide) which may occur during braking and/or acceleration when the rail 22 is wet. The wheel 16 may tend to slip relative to the rail 22 during emergency braking conditions. Of course, the wheel 16 may also tend to slip relative to the rail 22 during normal (non-emergency) braking conditions.

In order to eliminate or at least minimize slippage of the wheel 16 relative to the rail 22, a granular material application system 30 (FIGS. 1 and 2) may be provided on the train 10. The granular material application system 30 is operable to apply granular material to the upper surface 24 (FIG. 1) of the rail 22 at a location immediately ahead of the wheel 16. The granular material applied to the rail 22 increases friction between the wheel 16 and rail 22 to thereby improve traction of the wheel. The resulting improved traction promotes improved acceleration of the train on a slippery rail 22 and promotes improved braking of the train on a slippery rail. Although the granular material application system 30 may be used to apply any one of many different known granular materials to the rail 22, in the illustrated embodiment of the invention, the granular material application system 30 applies sand to the rail 22.

Figure 2:
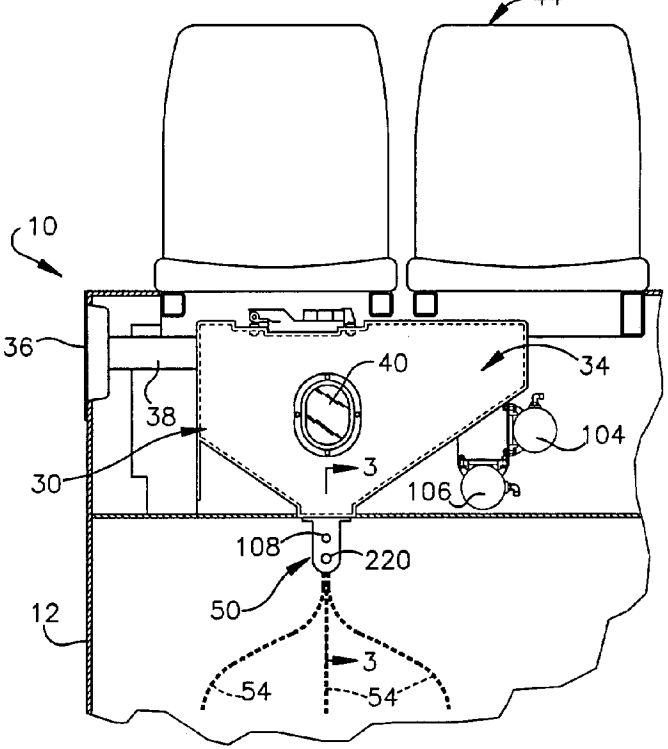
FIG. 2 is a fragmentary schematic illustration, on an enlarged scale, taken generally along the line 2—2 of FIG. 1, further illustrating the construction of a portion of the apparatus.

The granular material application system 30 includes a granular material supply container 34 which is filled with granular material, such as sand or quartz, through a fill door 36. The fill door 36 is connected with the interior of the container 34 through a pipe or conduit 38 (FIG. 2). A sight window 40 is provided on the container 34 to facilitate checking the amount of granular material in the container.

In the embodiment of the invention illustrated in FIGS. 1 and 2, the metal container 34 is disposed beneath a seat 44 in the car 12 of the train 10. Of course, the container 34 could be positioned at a different location on the train 10 if desired. For example, the container 34 could be located on the truck along with the wheel 16.

The granular material application system 30 also includes a granular material injection assembly 50. The granular material injection assembly 50 is supplied with granular material from the container 34. The granular material injection assembly 50 is connected with a nozzle 52 (FIG. 1) by a flexible hose or conduit 54. The conduit 54 conducts a flow of granular material and air from the granular material injection assembly 50 to the nozzle 52.

The flow of granular material and air is directed toward the upper surface 24 of the rail 22 by the nozzle 52 at a location adjacent to the wheel 16. The nozzle 52 is effective to direct the flow of granular material onto the track 20 at a location immediately ahead of the wheel 16 so that the wheel rolls over the granular material. The nozzle 52 may have any desired construction. By having the granular material disposed between the peripheral surface of the wheel 16 and the rail 22, traction between the wheel and the rail is improved.

Granular Material Injection Assembly

The granular material injection assembly 50 (FIG. 3) includes a housing 60. The one-piece metal housing 60 has a flange 62 which is connected to the lower end portion of the container 34 (FIGS. 1 and 2). Although it is believed that it may be desired to connect the housing 60 directly to the container 34, in the manner illustrated in FIGS. 1 and 2, the housing may be spaced from the container. If the housing 60 is to be spaced from the container 34, a suitable hose or conduit would be provided to conduct granular material from the container to the housing.

Figure 3:
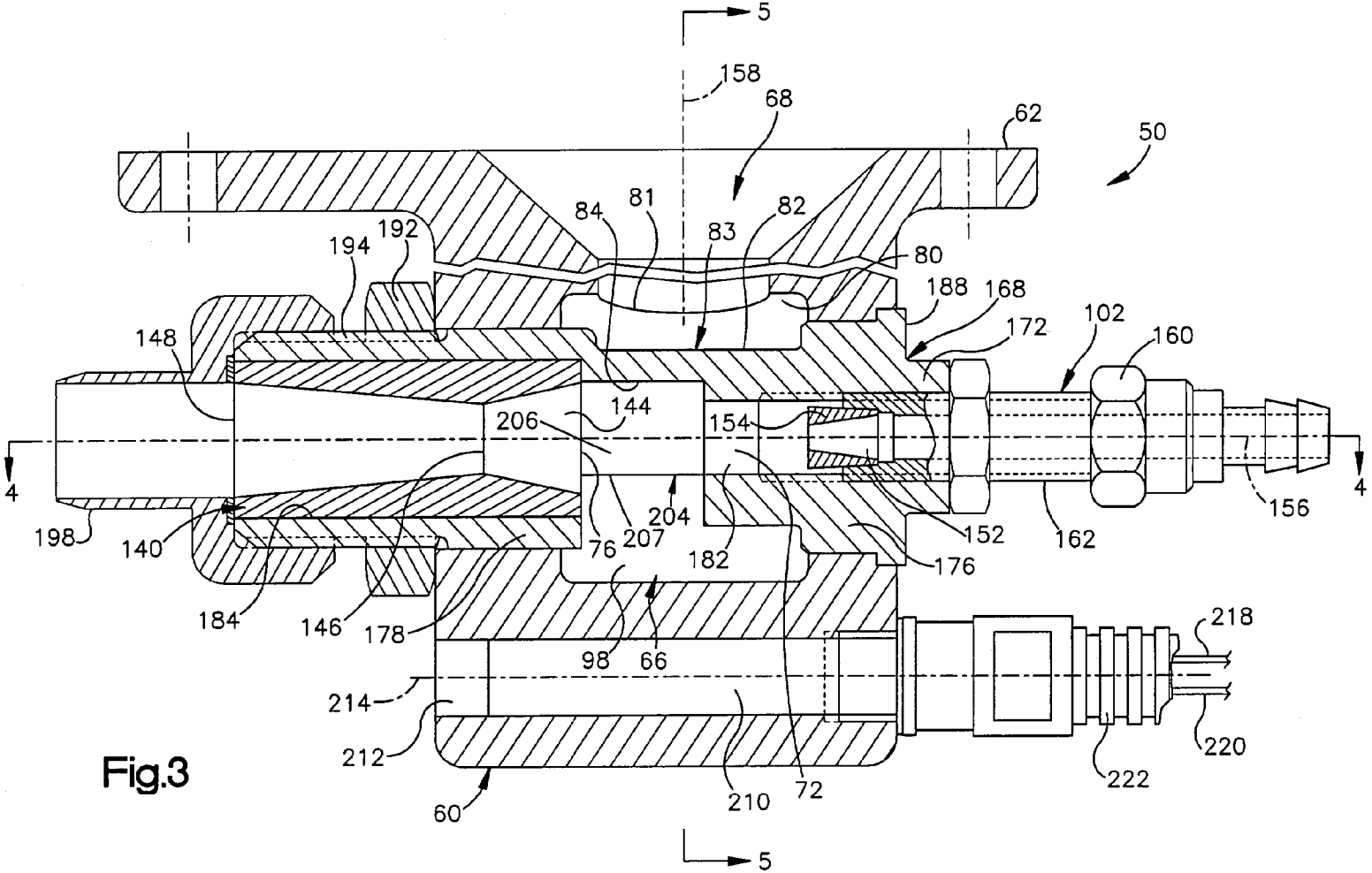
FIG. 3 is a fragmentary schematic sectional view, taken on an enlarged scale along the line 3—3 of FIG. 2, illustrating the construction of a granular material injection assembly which forms part of the apparatus of FIGS. 1 and 2.
Figure 5:
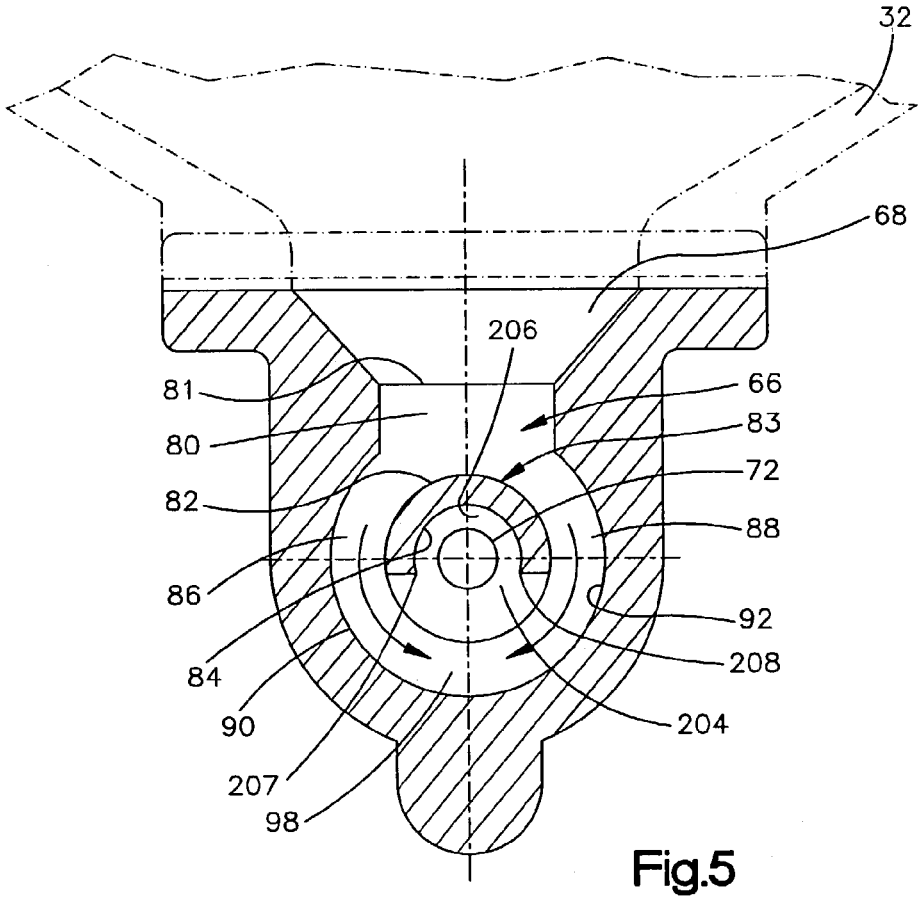
FIG. 5 is a schematic fragmentary sectional view, taken on a reduced scale along the line 5—5 of FIG. 3, further illustrating the construction of the granular material injection assembly.

The housing 60 of the granular material injection assembly 50 includes a generally cylindrical mixing chamber 66 (FIGS. 3 and 5). Granular material flows from the container 34 through an inlet 68 into the mixing chamber 66. A stream of air under pressure is conducted to the mixing chamber 66 at an air inlet 72. The granular material becomes entrained in the flow of air from the inlet 72.

The flow of air and suspended granular material moves from the mixing chamber 66 through an air and granular material outlet 76. The air and granular material outlet 76 is aligned with the air inlet 72. The air and entrained granular material then flows from the housing 60 along a conduit 54 (FIG. 1) to the nozzle 52. The nozzle 52 directs the flow of air and granular material onto the upper surface 24 of the rail 22.

The granular material is supplied to the granular material injection assembly 50 from the container 34 (FIG. 2). The granular material flows into an upper portion 80 (FIG. 3) of the mixing chamber 66 through a circular inlet 81. As the granular material flows from the container 34 through the granular material inlet 68 to the upper portion 80 of the mixing chamber 66, the granular material engages an arcuate outer surface 82 on a deflector 83. The deflector 83 has an arcuate inner surface 84 which is concentric with the outer surface 82. The deflector 83 is formed of metal and extends across the mixing chamber 66. The deflector 83 deflects the granular material towards openings 86 and 88 (FIGS. 4 and 5) disposed adjacent to opposite sides 90 and 92 of the mixing chamber 66. Central axes of the air inlet 72 and air and granular material outlet 76 are coincident with central axes of the outer and inner surfaces 82 and 84 of the deflector 83.

The deflector surface 82 (FIGS. 3 and 5) is effective to deflect the granular material towards opposite sides 90 and 92 of the mixing chamber 66. This results in the granular material accumulating in a lower portion 98 of the mixing chamber 66 in such a manner as to prevent packing of the granular material between the air inlet 72 and the air and granular material outlet 76. By preventing packing of the granular material between the air inlet 72 and air and granular material outlet 76 (FIG. 3), the deflector 83 enables the granular material to be easily aspirated into the stream of air flowing from the air inlet 72 along the inner surface 84 of the deflector toward the air and granular material outlet 76. If the granular material was allowed to become firmly packed in the space between air inlet 72 and air and granular material outlet 76 (FIG. 3), difficulty may be encountered in suspending the granular material in the flow of air as it moves across a portion of the mixing chamber 66 disposed between the air inlet 72 and air and granular material outlet 76.

The illustrated deflector 83 has an arcuate configuration. However, it is contemplated that the deflector 83 could have a different configuration. For example, the deflector 83 may be formed with a pair of outer side surfaces, corresponding to the surface 82, which intersect at a peak or ridge which extends parallel to the central axis of the deflector. This would result in the deflector 83 having outer side surfaces which form two sides of a triangle. Alternatively, the deflector 83 may be formed with an outer side surface having a configuration similar to the configuration of a gambrel roof. The inner side surface 84 of the deflector 83 may have a configuration corresponding to the configuration of the outer side surface 82 or maintain the arcuate configuration illustrated in FIG. 5 even though the outer surface 82 of the deflector has a different configuration. If desired, the deflector 83 may have a configuration similar to the configuration of a flat plate. Rather than being centered in the mixing chamber 66, the deflector 83 could be offset to one side of the mixing chamber and direct the flow of granular material towards the opposite side of the mixing chamber.

Although it is preferred to utilize the deflector surface 82 to split the flow of granular material between the openings 86 and 88 (FIGS. 4 and 5), the deflector 83 could be omitted if desired. If the deflector 83 is omitted, it is believed that it may be desired to have the granular material enter the mixing chamber 66 at a location offset to one side of the air inlet 72 and the air and granular material outlet 76. This would be done to enable the granular material to be readily aspirated into the flow of air from the inlet 72 and maintained in suspension in the flow of air as the air and granular material moves through the outlet 76.

Air is directed from a valve assembly 102 (FIGS. 3 and 4) through the air inlet 72 into the mixing chamber 66. The valve assembly 102 is adjustable to enable the rate of flow of air from the air inlet 72 to be adjusted. By adjusting the valve assembly 102, the rate of flow of air from the air inlet 72 can be adjusted to a desired range of air flow rates for a particular train 10. However, if adjusting the air flow rate is not desired, the valve assembly 102 may be omitted. If the valve assembly 102 is omitted, a fixed orifice may be utilized to form the air inlet 72.

Figure 6:
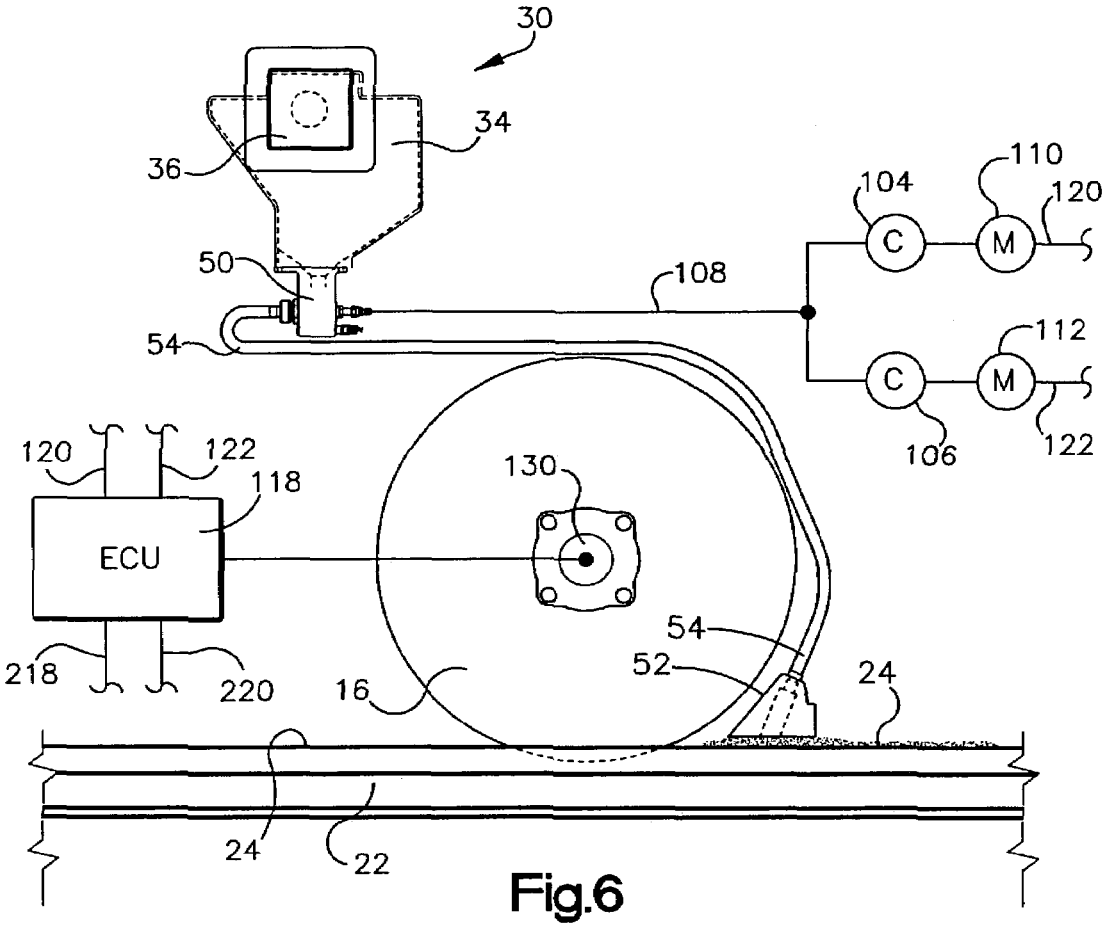
FIG. 6 is a schematic illustration depicting the relationship of a plurality of compressors and motors to the granular material injection assembly of FIGS. 3 and 4 and to a control apparatus.

Air is conducted to the valve assembly 102 from a pair of compressors 104 and 106 (FIG. 6). The compressors 104 and 106 are connected with the valve assembly 102 through a conduit 108. The compressors 104 and 106 are driven by variable speed motors 110 and 112. By varying the operating speed of the motors 110 and 112, the pressure of air supplied by the compressors 104 and 106 can be varied. If desired, a single motor 110 or 112 and a single compressor 106 or 108 may be utilized. If desired, air under pressure may be supplied to the valve assembly 102 from a reservoir or other source. If this is done, a valve may be provided to control the flow of air to the granular material injection assembly 50.

When it is desired to have air and entrained granular material flow from the nozzle 52 (FIG. 1) onto the rail 22, an electronic control unit 118 (FIG. 6) energizes the motors 110 and 112 through leads 120 and 122. When the electronic control unit 118 interrupts operation of the motors 110 and 112, the compressors 104 and 106 stop and the flow of air through the conduit 108 to the valve assembly 102 is interrupted. An operator of the train 10 can provide input to the electronic control unit 118 to initiate operation of the motors 110 and 112 and to vary the operating speed of the motors. This initiates a flow of air and varies the rate of flow of air from the compressors 104 and 106 to the valve assembly 102.

The electronic control unit 118 (FIG. 6) is connected with sensors, such as a wheel speed sensor 130. The electronic control unit 118 compares the outputs for wheel speed sensors 130 for each of the wheels 16 of the train 10. The electronic control unit 118 effects operation of the motors 110 and 112 to drive the compressors 104 and 106 associated with any one of the wheels 16 when the input from the sensors 130 indicate that there is slippage between the one wheel and the rail 22. The slippage may occur during acceleration of the train 10 or during braking of the train.

The electronic control unit 118 is effective to vary the speed of operation of the motors 110 and 112. Varying the speed of operation of the motors 110 and 112 varies the speed of operation of the compressors 104 and 106. Varying the speed of operation of the compressors 104 and 106 varies the rate of flow of air through the conduit 108 to the mixing chamber 66 (FIG. 3). Varying the rate of flow of air to the mixing chamber 66 varies the rate of flow of and granular material from the mixing chamber 66 to the rail 22. If desired, a solenoid or other device may be provided to adjust the valve assembly 102 as a function of variations in the speed of the train or extent of slippage of an associated wheel relative to the rail 22.

The outputs from the wheel speed sensors 130 (FIG. 6) enable the electronic control unit 118 to determine the speed of the train. The electronic control unit 118 is effective to vary the speed of operation of the motors 110 and 112 as a function of variations in the speed of operation of the train 10. The greater the operating speed of the train 10, the greater is the speed at which the motors 110 and 112 are operated to drive the compressors 104 and 106.

The greater the speed at which the compressors 104 and 106 are driven, the greater is the output air pressure from the compressors and the greater is the air flow rate through the valve assembly 102 (FIG. 3). As the air flow rate from the valve assembly 102 increases, the rate of flow of air and granular material through the outlet 76 increases. Therefore, as the speed of the train 10 increases, the electronic control unit 118 is effective to increase the rate at which granular material is conducted from the nozzle 52 to the rail 22.

When the wheel speed sensors 130 (FIG. 6) connected with the electronic control unit 118 indicates a condition corresponding to slippage of one or more wheels 16 of the train 10, the electronic control unit 118 energizes the motors 110 and 112 to drive the compressors 104 and 106 and supply air to the granular material injection assembly 50 associated with a slipping wheel 16 of the train. It should be understood that there is a granular material application system 30 associated with each wheel of the train. The electronic control unit 118 is operable to energize only the motors 110 and 112 to supply air to the granular material injection assembly 50 of the granular material application systems 30 associated with a slipping wheel 16 of a train 10.

A plurality of wheel speed sensors 130 may be provided. Each wheel speed sensor would be effective to detect slippage of an associated one of the wheel 16 of the train 10. By comparing the outputs from the wheel speed sensors 130, the electronic control unit 118 can detect which wheel 16 of a plurality of wheels is slipping relative to the rail 22. Assuming that only one wheel 16 is slipping relative to the rail 22, the electronic control unit 118 would effect operation of the granular material application system 30 associated with the slipping wheel. The granular material application systems 30 associated with the wheels of the train which are not slipping would not be operated.

Rather then having a separate granular material application system 30 for each of a plurality of wheels of a train, there may be only four granular material application systems. If there were only four granular material application systems 30, one granular material application system would be associated with the left front wheel or wheels of a train. A second granular material application system would be associated with the right front wheel or wheels of a train. A third granular material application system 30 would be associated with the left rear wheel or wheels of the train. A fourth granular material application system 30 would be associated with the right rear wheel or wheels of the train. Of course, if the train has more than four wheels, a granular material application system 30 could be provided for each wheel of a train if desired.

Alternatively, only two granular material application systems 30 may be provided. One granular material application system 30 would be operable to apply granular material to one of the tracks 22. The other granular material application system 30 would be operable to apply granular material to the other track 22.

A venturi 140 (FIG. 3) is provided in the air granular material outlet 76. The metal venturi 140 is of the converging-diverging type. The venturi 140 is effective to accelerate the flow of air as the air moves from an inlet 144 to the venturi through a throat 146 to an outlet 148 of the venturi. The throat 146 has a circular configuration and the inlet 144 and outlet 148 of the venturi have generally conical configurations. By accelerating the flow of air as it moves through the venturi 140, the aspiration of granular material into the flow of air is promoted. The venturi 140 may be formed of a metal which is resistant to wear by the granular material.

The illustrated venturi 140 includes a tube which is mounted on the housing 60. However, the tube may be omitted. If this is done, the venturi 140 may be formed as part of the housing 60. A passage may be formed in the material of the housing. The passage may have a constriction disposed between a relatively large diameter inlet to the passage and a relatively large diameter outlet from the passage. The velocity of flow of air through the constriction will be greater than the velocity of flow of air through the inlet to and outlet from the passage. A decrease in static pressure is associated with the increase in air flow velocity at the constriction and is effective to aspirate granular material into the passage.

The venturi 140 is disposed in a coaxial relationship with the generally cylindrical deflector 82 and the valve assembly 102. The valve assembly 102 includes a valve member 152 and valve seat 154 which are disposed along an axis 156 extending through the housing 60 in a direction perpendicular a central axis 158 of the granular material inlet 68 and mixing chamber 66. The central axis of the venturi 140 is coincident with the axis 156. Therefore, the valve assembly 152 and venturi 140 are disposed in a coaxial relationship so that a flow of air is directed from the valve assembly 152 across the mixing chamber 66 into the inlet 144 to the venturi 140.

When the high speed stream of air flows across the mixing chamber 66, granular material is aspirated into the flow of air. By having the valve assembly 102 in a coaxial relationship with the venturi 140, the flow of air from the valve assembly 102 is directed into the throat 146 of the venturi and is accelerated. This results in granular material being drawn upward from the lower end portion 98 of the mixing chamber 66 into the flow of air from the valve assembly 102 into the venturi 140. The cylindrical deflector surfaces 82 and 84 extend parallel to the axis 156 and are disposed above the axis to enable the deflector surface 82 to shield the flow of air from a flow of granular material entering the mixing chamber 66. If desired, the venturi 140 could be omitted and the outlet 76 sized to accommodate mixing of air and granular material in the chamber 66.

In the embodiment of the invention illustrated in FIG. 3, the metal valve member 152 is adjusted relative to the metal valve seat 154 by an adjusting nut 160. The adjusting nut 160 is movable along a body 162 of the valve assembly 102 to move the valve member 152 either toward or away from the valve seat 154. Once the position of the valve member 152 relative to the valve seat 154 has been adjusted to correspond to a desired range of air flow rates from the valve assembly 102 into the venturi 140, the adjusting nut 160 is effective to maintain the valve member in the desired position. The air flow rate is varied within the selected range of air flow rates by varying the speed of operation of the motors 110 and 112 and the speed of operation of the compressors 104 and 106.

It is contemplated that it may be desired to adjust the valve member 152 relative to the valve seat 154 during operation of the train 10. Thus, a stepper motor may be connected with the valve member 152 and operated to move the valve member relative to the valve seat 154 to vary the rate of flow of air from the valve assembly 102. The stepper motor may be connected with the valve member 152 and operated to move the valve member in a manner similar to that disclosed in U.S. Pat. Nos. 4,608,820; 4,969,628; and/or 6,375,086. Of course, the stepper motor could be connected with valve member and operated in any desired manner to effect movement of the valve member 152 relative to the valve seat 154.

The valve assembly 102 and venturi 140 advantageously form part of an insert assembly 168 (FIG. 3). The insert assembly 168 is connected with and extends through the housing 60. The insert assembly 168 is connected with the conduit 108 (FIG. 6) through which air is conducted to the valve assembly 102. The insert assembly 168 is also connected with the conduit 54 through which a flow of air and entrained granular material is conducted to the nozzle 52.

The insert assembly 168 includes a tubular, generally cylindrical, metal insert member 172 (FIG. 3). The one-piece, metal insert member 172 has a right (as viewed in FIG. 3) end portion 176 which is connected with the valve assembly 102. The insert member 172 has a cylindrical left (as viewed in FIG. 3) end portion 178 which is connected with the venturi 140. The insert member 172 has a central axis which is coincident with the axis 156.

The valve assembly 102 engages a cylindrical recess 182 in the right end portion 176 of the insert member 172. The venturi 140 engages a cylindrical recess 184 in the left end portion 178 of the insert member 172. The cylindrical recesses 182 and 184 are disposed in a coaxial relationship with each other and with the axis 156.

An annular flange 188 on the right end portion 176 of the insert member 168 engages the housing 60 to position to the insert member relative to the housing. An internally threaded member or lock nut 192 engages an external thread convolution 194 on the left end portion 178 of the insert member 172 to hold the insert member against movement relative to the housing 60. A tubular fitting 198 connects the left end portion 178 of the insert member 172 with the conduit 54 (FIGS. 1 and 5) through which air entrained granular material is conducted to the nozzle 52.

The deflector 83 forms part of the insert member 172 and extends between the right and left end portions 176 and 178 (FIG. 3) of the insert member 172. The coaxial deflector surfaces 82 and 84 have arcuate configurations conforming to the configuration of a portion of a cylinder. An axially extending opening 204 (FIGS. 3, 4 and 5) is formed in the insert member 172.

The opening 204 has a generally rectangular configuration with longitudinally extending edges which are parallel to the central axis 156. The opening 204 connects a space 206 (FIG. 5) disposed within the deflector 83 in fluid communication with the lower portion 98 of the mixing chamber 66. The space 206 within deflector 83 is formed as a portion of a cylinder and contains a portion of the axis 156. When the flow of air is directed from the air inlet 72 to the air and granular material outlet 76 (FIG. 3), granular material is aspirated upward from the lower portion, 98 of the mixing chamber 66 into the space 206 and becomes entrained in the flow of air from the air inlet 72. The air and entrained granular material flows from the space 206 through the air and granular material outlet 76 to the conduit 54 and nozzle 52 (FIG. 1).

The opening 204 is formed in the deflector 83. The opening 204 has a rectangular configuration and is partially defined by parallel edges 207 and 208 formed on the deflector 83. The parallel edges 207 and 208 extend parallel to the central axis 156 and to the path of flow of air from the air inlet 72 to the air and granular material outlet 76 (FIG. 3). Although the opening 204 has a rectangular configuration, it is contemplated that the opening could be formed of a different configuration. For example, the opening 204 may have a circular configuration. Although a single opening 204 has been provided in the deflector 83, it is contemplated that a plurality of openings may be provided in the deflector. For example, a plurality of slots or similar openings may be formed in the deflector 83.

The deflector surfaces 82 and 84 extend for more than 180° (FIG. 3) around the exterior of the insert member 172. The deflector surface 82 is effective to block a direct flow of granular material from the inlet 68 to the space between the valve assembly 102 and venturi 140. The granular material entering the mixing chamber 66 flows through the opening 81 and is engaged by the arcuate deflector surface 82. The deflector surface 82 directs the flow of granular material to the openings 86 and 88 (FIG. 4) disposed on opposite sides of the insert member 172. Therefore, the granular material flows downward and radially outward along the deflector surface 82 toward the lower end portion 98 of the mixing chamber 66 without passing through the flow of air from the valve assembly 102.

The flow of air from the valve assembly 102 is effective to induce an upward flow of granular material from the lower end portion 98 of the mixing chamber 66 into the venturi 140. As the granular material becomes entrained in the flow of air, it moves into the venturi 140 toward the fitting 198 and the conduit 54. Although it is preferred to have the valve assembly 102, venturi 140, and deflector 82 as part of a unitary insert assembly 168, the various components of the insert assembly may be mounted separately if desired.

In order to prevent freezing of the granular material in the mixing chamber 66, a heating element 210 (FIG. 3) is disposed in a cylindrical recess 212 in the housing 60. The recess 212 is disposed beneath the mixing chamber 66 and has a longitudinal central axis 214 which extends parallel to the longitudinal central axis 156 of the insert assembly 168. The heater element 210 is connected with the electronic control unit 118 (FIG. 5) by leads 218 and 220. The electronic control unit 118 energizes the heater element 210 to maintain the granular material (sand) in the mixing chamber 66 at a temperature above freezing. The leads 218 and 220 are disposed in a protective conduit 222 which is connected with the housing 60.

A temperature sensor is connected with the electronic control unit 118. In response to the detection of a predetermined temperature, the electronic control unit effects energization of the heater element 210 with electric current conducted over the leads 218 and 220. It is contemplated that the heater element 210 may be deenergized when the outside temperature is above a predetermined temperature, for example, 40° F. Under certain circumstances, it may not be necessary to have a heater element 210 and the heater element may be omitted.

Operation

During operation of the train 10, the granular material application system 30 will be activated whenever there is a slipping of the wheel 16 relative to the rail 22. This slipping may occur during acceleration of the train or deceleration of the train. Although only a single granular material application system 30 has been illustrated in FIGS. 1–6, it should be understood that a separate granular material application system may be provided for each wheel 16 of the train 10. Alternatively, a granular material application system 30 may be utilized in association with a plurality of wheels 16 of the train. If this was done, there would be at least two granular material applications systems 30, that is one for each rail 22 of the track 20.

A wheel speed sensor 130 (FIG. 6) is connected with each wheel 16 of the train 10. The electronic control unit 118 continuously compares the outputs of the wheel speed sensors 130. When the electronic control unit 118 detects that one of the wheels 16 is spinning either faster or slower than other wheels and is therefore slipping, the electronic control unit is effective to activate the granular material application system 30 associated with the slipping wheel. One of the wheels 16 may be slipping relative to the rail 22 when it is going either faster or slower than the other wheels of the train 10.

When the electronic control unit 118 detects that the wheel 16 (FIG. 6) is slipping, that is rotating at a speed different than the speed of the other wheels of the train, the electronic control unit energizes the motors 110 and 112. Energization of the motors 110 and 112 drives the compressors 104 and 106 to supply air under pressure through the conduit 108 to the granular material injection assembly 50. Since there are two motors 110 and 112 and two compressors 104 and 106, a failure of any one motor and/or compressor is ineffective to disable the system. However, to minimize cost and other reasons, one of the motors and one of the compressors may be omitted if desired.

The rate at which the motors 110 and 112 drive the compressors 104 and 106 will vary as a function of the extent of slippage of the wheel 16 relative to the rail 22. The greater the extent of slippage, the greater will be the speed at which the motors 110 and 112 will be operated. The greater the speed at which the motors 110 and 112 are operated, the greater will be the pressure of the air supplied through the conduit 108 to the granular material injection assembly 50.

In addition, the electronic control unit 118 is operable to vary the speed of operation on the motors 110 and 112 as a function of the speed of operation of the train. Thus, in response to the same amount of slippage of the wheel 16 relative to the rail 22, the electronic control unit 118 is effective to energize the motors 110 and 112 to drive the compressors faster if the train is moving at a relatively high speed than if the train is moving at a relatively slow speed. Therefore, the rate at which the compressors 104 and 106 are driven varies as a function of variations in the extent of slippage of the wheel 16 relative to the rail 22 and as a function of the speed of the train 10.

The high pressure air is conducted from the conduit 108 through the valve assembly 102 (FIGS. 3 and 4) to the venturi 140. This flow of air induces granular material to flow upward from the lower end portion 98 of the mixing chamber 66 into the venturi 140 with an aspirating action. The flow of air and entrained granular material is conducted from the venturi 140 through the conduit 54 to the nozzle 52. The granular material is directed from the nozzle 52 onto the upper surface 24 of the rail 22.

The rate of flow of granular material from the granular material injection assembly 50 will vary as a function of variations in the rate of flow of air from the valve assembly 102. The greater the rate of flow of air from the valve assembly 102, the greater will be the rate of flow of granular material from the mixing chamber 66 through the venturi 140 and conduit 54 to the nozzle 52.

It is contemplated that the rate of flow of granular material may vary in a range of between 250 and 1,500 grams per minute. It is contemplated that the compressors 104 and 106 will be driven by the motors 110 and 112 to supply air to the valve assembly 102 at a pressure of 30 psi (pounds per square inch) or less. Of course, the specific rates of flow of granular material to and from the granular material injection assembly 50 and the specific pressure at which air is supplied to the granular material injection assembly will depend upon the operating characteristics of a train 10 with which the granular material application system 30 is associated. Relatively large heavy trains may require a greater flow of air at a higher pressure and a greater flow of granular material than relatively small light trains.

The valve assembly 102 can be manually set to determine a range of flow of granular material. Thus, the valve assembly 102 may be set to have the rate of flow of granular material be between a rate somewhat in excess of 1,500 grams per minute and a rate of 800 grams per minute. Alternatively, the valve assembly 102 could be set to have the rate of flow of granular material be between 1,000 and 300 grams per minute. The setting of the valve assembly 102 will depend upon the characteristics of the train 10 with which the valve assembly is associated and the ambient conditions in which the train is to be operated.

As was previously mentioned, a stepper motor may be connected with the valve assembly 102 to enable the electronic control unit 118 to vary the setting of the valve assembly 102. This would enable the electronic control unit 118 to vary the rate of flow of granular material to the rail by varying the setting of the valve assembly 102 and by varying the speed at which the motors 110 and 112 drive the compressors 104 and 106. Although the compressors 104 and 106 could have many different constructions, it is contemplated that it may be desired to form many of the parts of the compressors of stainless steel in order to enhance the durability of the compressors.

It is contemplated that the electronic control unit 118 will effect operation of the granular material application system 30 during different operating conditions. These operating conditions may include spin-slide (slip-slide) which may occur when a vehicle starts up and the steel wheel 16 slips on the rail 22. Only one of the wheels 16 may be slipping. The electronic control unit 118 would effect operation of only the granular material application system 30 associated with the slipping wheel. The granular material application systems 30 associated with the wheels which are not slipping remain inactive.

The electronic control unit 118 may effect operation of all the granular material application systems 30 when there is an emergency braking condition. This would result in the application of granular material to the rail 22 adjacent to all the wheels of the train in order to maximize the traction of the wheels and minimize the stopping distance of the train.

During a normal (non-emergency) braking condition, the electronic control unit 118 may activate all of the granular material application systems 30. However, the granular material applications system 30 associated with a slipping wheel would be effective to supply granular material a rail 22 at a greater rate than granular material application system 30 which are not associated with slipping wheels. Thus, the electronic control unit 118 would be operative to effect the application of granular material to the rails 22 at different rates from different granular material application systems 30 during either braking or acceleration of the train 10. This would enable granular material to be applied at a greater rate adjacent to wheels which are slipping to a greater extent than other wheels of the train 10.

When the train 10 is being operated under normal operating conditions and a normal braking condition is undertaken, the electronic control unit 118 effects operation of the granular material application systems 30 at a rate which varies as a function of the speed of the train 10. Thus, the greater the speed at which the train 10 is traveling, the greater is the rate at which granular material is applied to the rails 22 by the granular material application system 30. When the train is moving slowly and encounters a non-emergency braking situation, the motors 110 and 112 are energized by the electronic control unit 118 to drive the compressors 104 and 106 at a relatively slow speed. This results in application of granular material at a relatively low rate to the rails 22. However, when the train is traveling at a higher speed, the electronic control unit 118 energizes the motors 110 and 112 to drive the compressors 104 and 106 at a higher speed to effect the application of granular material to the rails 22 at a relatively high rate.

It should be understood that the electronic control unit 118 may cooperate with the material application system in a different manner. If desired, the electronic control unit 118 may be omitted. If this is done, a valve may be manually actuated to initiate a flow of air to the granular material injection assembly 50. As was previously mentioned, air may be supplied from a source other than the compressors 104 and 106.

The granular material injection assembly 50 has no moving parts to wear out. Therefore, it is believed that only minimum maintenance will be required. However, in the unlikely event that the valve assembly 102 and/or venturi 140 need to be replaced, this may be readily done by removing the insert assembly 168 from the housing 60 and positioning a new insert assembly in the housing. By having the valve assembly 102 and venturi 140 held by the insert member 172, they are positioned in a coaxial relationship with each other when they are moved into the housing 60. This facilitates initial assembly of the granular material to injection assembly 50 and facilitates subsequent maintenance (if required) of the granular material injection assembly.

Granular Material Application System

Figure 7:
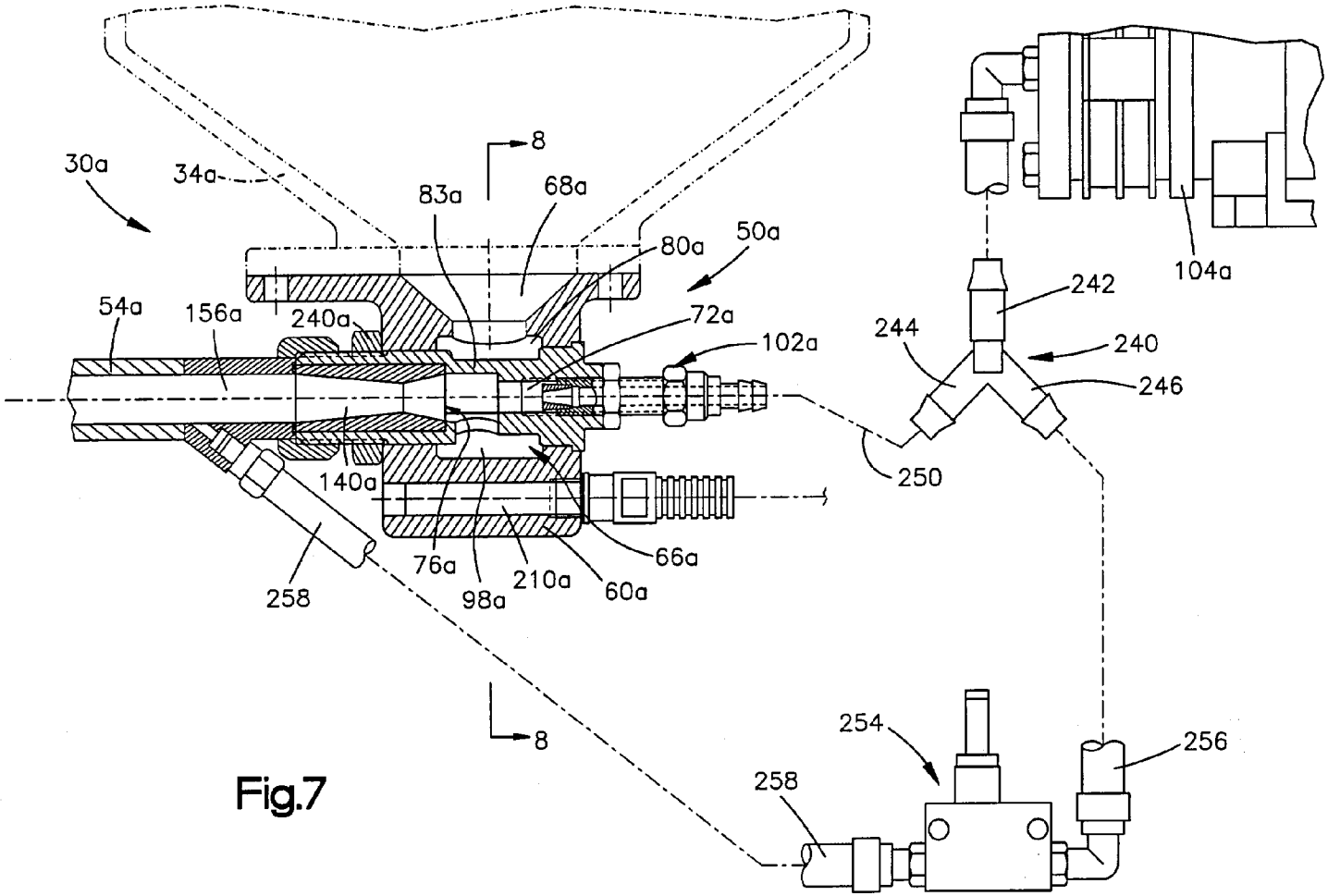
FIG. 7 is a schematic illustration depicting the relationship of a compressor to a second embodiment of the granular material injection assembly.
Figure 8:
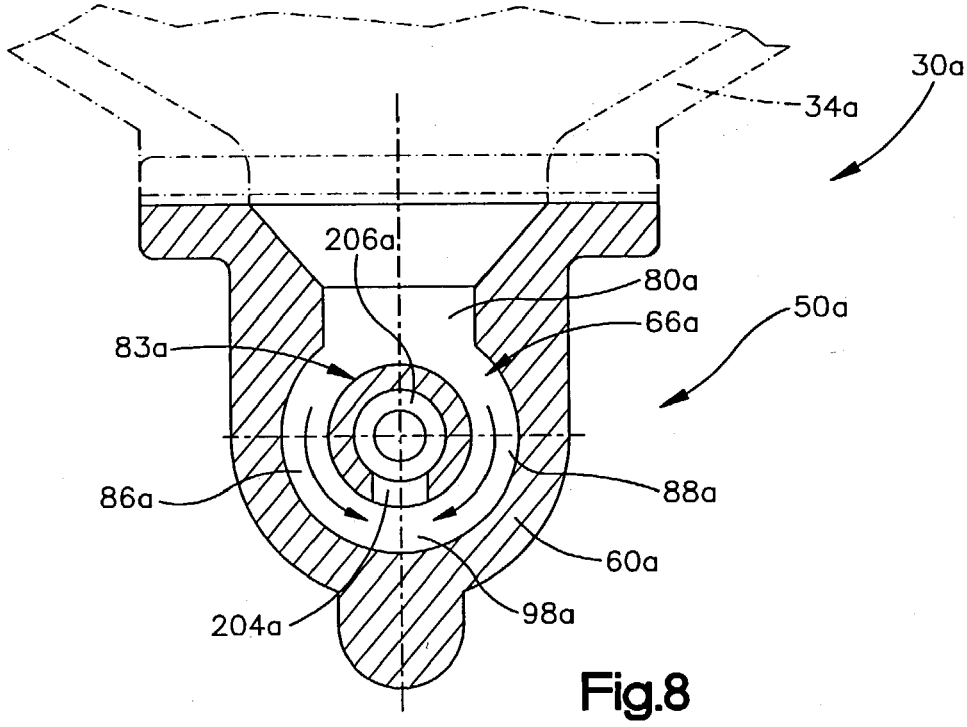
FIG. 8 is a schematic fragmentary sectional view, taken on an enlarged scale along the line 8—8 of FIG. 7, further illustrating the construction of the granular material injection assembly.

In the embodiment of the granular material application system 30 illustrated in FIGS. 1–6, air is supplied from a compressor to the valve assembly 102. In the embodiment of the invention illustrated in FIGS. 7 and 8, air is supplied from a compressor to both a valve assembly and to a conduit connected with a nozzle which applies granular material to the track. In addition, the embodiment of the invention illustrated in FIGS. 7 and 8 has an alternative deflector construction. Since the embodiment of the invention illustrated in FIGS. 7 and 8 is generally similar to the embodiment of the invention illustrated in FIGS. 1–6, similar numerals will be utilized to identify similar components. The suffix letter "a" is associated with the numerals of FIGS. 7 and 8 to avoid confusion.

A granular material application system 30*a* (FIG. 7) is operable to apply granular material to an upper surface of a rail immediately ahead of a wheel of a train in the same manner as previously described in conjunction with the embodiment of the invention illustrated in FIG. 1. The granular material application system 30*a* includes a granular material supply container 34*a* which is filled with a granular material, such as sand or quartz. The container 34*a* may be disposed beneath a seat in a car of a train 10 in the manner previously described in conjunction with the embodiment of the invention illustrated in FIG. 1.

The granular material application system 30*a* (FIG. 7) includes a granular material injection assembly 50*a*. The granular material injection assembly 50*a* is supplied with granular material from the container 34*a*. The granular material injection assembly 50*a* is connected with a nozzle, corresponding to the nozzle 52 of FIG. 1, by a flexible hose or conduit 54*a* (FIG. 7). A flow of granular material and air is directed toward the upper surface of a rail by the nozzle at a location adjacent to a wheel of a train.

The granular material injection assembly 50*a* (FIG. 7) includes a housing 60*a* which is connected to the lower end portion of the container 34*a*. The housing 60*a* of the granular material injection assembly 50*a* includes a generally cylindrical mixing chamber 66*a*. Although the mixing chamber 66*a* has a cylindrical configuration corresponding to the generally cylindrical configuration of the mixing chamber 66 of FIGS. 3 and 5, it is contemplated that the mixing chamber could be formed with a different configuration if desired. For example, the mixing chamber 66*a* may be formed with a rectangular configuration.

Granular material flows from the container 34*a* through a circular inlet 68*a* into the mixing chamber 66*a*. A stream of air under pressure is conducted to the mixing chamber 66*a* at an air inlet 72*a*. The granular material becomes entrained in the flow of air from the inlet 72*a*.

The flow of air and suspended granular material moves from the mixing chamber 66*a* through an air and granular material outlet 76*a*. The air and granular material outlet 76*a* is aligned with the air inlet 72*a*. The air and entrained granular material then flows from the housing 60*a* along a conduit 54*a* to a nozzle corresponding to the nozzle 52 of FIG. 1. The nozzle directs the flow of air and granular material onto the upper surface of the rail.

As the granular material flows from the container 34*a* through the granular material inlet 68*a* to the upper portion 80*a* of the mixing chamber 66*a*, the granular material engages an arcuate outer surface of a deflector 83*a*. The deflector 83*a* is formed of metal and extends across the mixing chamber 66*a*. The deflector 83*a* deflects the granular material toward openings 86*a* and 88*a* (FIG. 8) disposed adjacent to opposite sides of the mixing chamber 66*a*. Central axes of the air inlet 72*a* and the air and granular material outlet 76*a* are coincident with an axis 156*a*. The deflector 83*a* has a central axis which is also coincident with the axis 156*a*.

Air is directed from a valve assembly 102*a* through the air inlet 72*a* into the mixing chamber 66*a*. The valve assembly 102*a* may be adjustable to enable the rate of flow of air from the air inlet 72*a* to be adjusted. However, if adjusting of the air flow rate is not desired, the valve assembly 102*a* may be omitted. If the valve assembly 102*a* is omitted, a fixed orifice may be utilized to direct a flow of air into the mixing chamber 66*a*.

Air is conducted to the valve assembly 102*a* from a compressor 104*a*. Although only a single compressor 104*a* has been illustrated in FIG. 7, it should be understood that a pair of compressors, corresponding to the compressors 104 and 106 of FIG. 6, may be utilized if desired. The compressor 104*a* is driven by a variable speed motor (not shown). By varying the operating speed of the motor, the pressure of air supplied by the compressor 104*a* can be varied. Suitable censors and controls may be provided in association with the motor to enable a speed of operation of the compressor 104*a* to be varied as a function of variations in the speed of operation of the train with which the granular material application system 30*a* is associated.

A venturi 140*a* is provided in the air and granular material outlet 76*a*. The venturi 140*a* promotes aspiration of granular material from the lower end portion 98*a* of the mixing chamber 66*a* into the flow of air from the valve assembly 102*a*. The venturi 140*a* may be formed separately from the housing 60*a*, as illustrated in FIG. 7, or integrally formed as one piece with the housing. If desired, the venturi 140*a* may be omitted.

In order to prevent freezing of granular material in the mixing chamber 66*a*, a heating element 210*a* is disposed in a cylindrical recess in the housing 60*a*. The heating element 210*a* is energized to maintain the granular material (sand) in the mixing chamber 66*a* at a temperature above freezing. If desired, the heating element 210*a* may be omitted.

In accordance with one of the features of the embodiment of the invention illustrated in FIGS. 7 and 8, air from the compressor 104*a* is conducted to both the valve assembly 102*a* and the conduit 54*a*. To connect a compressor 104*a* with both the valve assembly 102*a* and the conduit 54*a*, a flow splitter 240 is provided. The flow splitter 240 includes an inlet section 242 which is connected in fluid communication with the compressor 104*a*. The flow splitter 240 has a pair of outlet sections 244 and 246 which are connected in fluid communication with the inlet section 242.

Air from the outlet section 244 is conducted to the valve assembly 102*a* through a conduit indicated schematically at 250 in FIG. 7. The outlet section 246 of the flow splitter 240 is connected with a pressure reducing valve assembly 254 by a conduit 256. The pressure reducing valve assembly 254 is connected with the conduit 54*a* at a location downstream from the housing 60*a* by a conduit 258.

During operation of the granular material injection assembly 50*a*, high pressure air flows from the compressor 104*a* to the inlet section 242 of the flow splitter 240. A portion of the high pressure air is conducted from the outlet section 244 of the flow splitter 240 to the valve assembly 102*a*. Similarly, a portion of the high pressure of air is conducted from the outlet section 246 of the flow splitter assembly 240 through the conduit 256 to the pressure reducing valve assembly 254. The pressure reducing valve assembly 254 is connected in fluid communication with the conduit 54*a* through the conduit 258. The pressure reducing valve assembly 254 is effective to reduce the fluid pressure transmitted to the conduit 258 to a pressure which is less than the fluid pressure transmitted through the conduit 250 to the valve assembly 102*a*. The rate of flow of air to the pressure reducing valve assembly 254 is greater than the rate of flow of air to the valve assembly 102*a*.

Relatively high pressure air from the valve assembly 102*a* is directed into the venturi 140*a* which is aligned with the valve assembly 102*a*. The venturi 140*a* and valve assembly 102*a* have central axes which are coincident with the axis 156*a*. Granular material is aspirated from a lower portion 98*a* of the mixing chamber 66*a* into the flow of air from the valve assembly 102*a*. The flow of air and entrained granular material from the venturi 140*a* to the conduit 54*a* is at a relatively low pressure. The flow of air from the pressure reducing valve assembly 254 and conduit 258 into the conduit 54*a* augments the low pressure flow of air in the conduit 54*a*.

Figure 4:
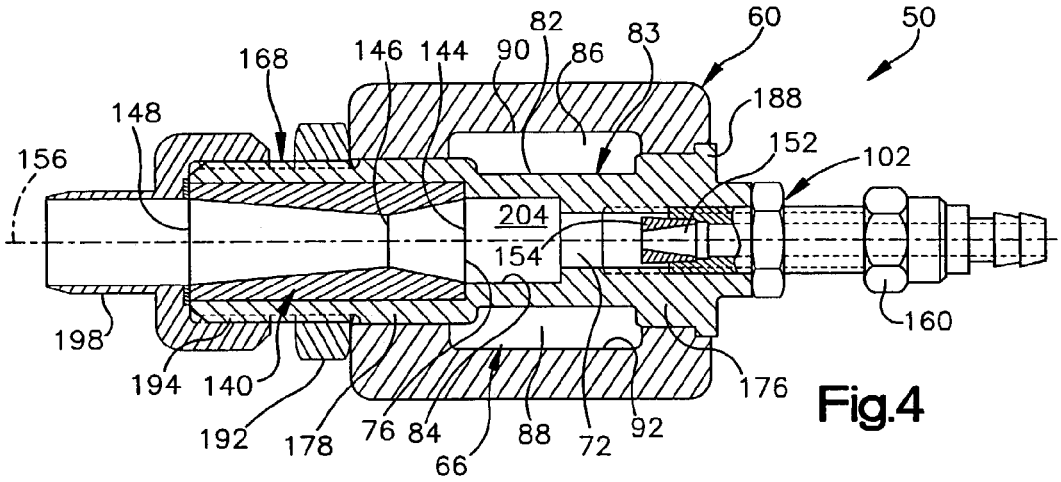
FIG. 4 is a fragmentary schematic sectional view, taken on a reduced scale along the line 4—4 of FIG. 3, further illustrating the construction of the granular material injection assembly.

The deflector 83*a* has the same general construction and is utilized in the same manner as was previously explained in conjunction with the deflector 83 of FIGS. 3–5. However, the deflector 83*a* has a circular opening 204*a* (FIG. 8) through which granular material is conducted from the lower portion 98*a* of the mixing chamber 66*a* into a cylindrical space 206*a* in the deflector 83*a*. The flow of granular material into the space 206*a* in the deflector 83*a* is entrained in the flow of air directed from the valve assembly 102*a* through the air inlet 72*a* to the air and granular material outlet 76*a* and venturi 140*a* (FIG. 7).

Although the opening 204*a* has a circular configuration, it is contemplated that the opening could have a different configuration if desired. For example, the opening 204*a* could have a polygonal configuration. Alternatively, the opening 204*a* could be formed by a plurality of openings disposed in the deflector 83*a*.

The granular material application system 30*a* is constructed and operated in the same manner as is disclosed in German Patentanmeldung entitled Druckluftbetriebene Sandstreuvorrichtung und Verfahren zum Streuen von Sand prepared by Patentanwälte Bungartz & Kreutzer, Duisburg (Docket No. 104P01DE Beschreibung and German Patent Authority Identification Number 10252466.1). The disclosure in the aforementioned German Patentanmeldung is hereby incorporated herein in its entirety by this reference thereto.

Alternative Deflector Orientation

Figure 9:
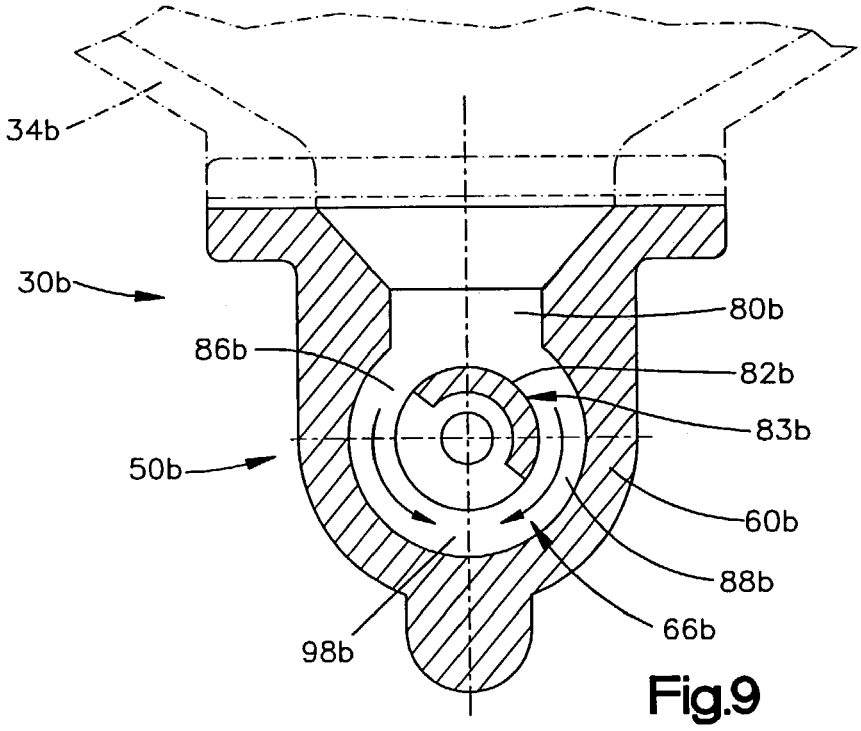
FIG. 9 is a schematic fragmentary sectional view, generally similar to FIGS. 5 and 8, illustrating the manner in which a deflector may be positioned in an asymmetrical relationship relative to a granular material inlet to a mixing chamber in the granular material injection assembly of FIG. 3 or 7.

In the embodiment of the invention illustrated in FIGS. 1–8, the deflector 83 is positioned with the opening 204 aligned with a vertical axis through the deflector. This results in passages 86 and 88 being of the same length. In the embodiment of the invention illustrated in FIG. 9, the deflector is oriented with the opening to the deflector skewed relative to a vertical axis. Since the embodiment of the invention illustrated in FIG. 9 is generally similar to the embodiments of the invention illustration in FIGS. 1–8, similar numerals will be utilized to designate similar components. The suffix letter "b" being associated with the numerals of FIG. 9 to avoid confusion.

A granular material application system 30*b* is used to apply any one of many different known granular materials to a rail to minimize slippage of a wheel of a train. The granular material application system 30*b* includes a granular material supply container 34*b* which is filled with granular material, such as sand or quartz. The granular material supply container 34*b* may be disposed beneath a seat of a car of a train in the manner illustrated in FIG. 1. Of course, the granular material 34*b* may be positioned in a different location on the train if desired.

The granular material application system 30*b* also includes a granular material injection assembly 50*b*. The granular material injection assembly 50*b* is supplied with granular material from the container 34*b*. The granular material injection assembly 50*b* is connected with a nozzle, corresponding to the nozzle of 52 of FIG. 1, by a flexible hose or conduit corresponding to the flexible hose or conduit 54 of FIG. 1. The granular material conducted from the granular material injection assembly 50*b* is applied to the upper surface of a rail in the same manner as previously discussed in association with the embodiments of the invention illustrated in FIGS. 1–8.

The granular material flows into an upper portion 80*b* of a mixing chamber 66*b* disposed in the housing 60*b*. As the granular material flows from the container 34*b* to the upper portion 80*b* of the mixing chamber 66*b*, the granular material engages an arcuate outer surface 82*b* on a deflector 83*b*. The deflector 83*b* has a same general construction as the deflector 83 of the embodiment of the invention illustrated in FIGS. 3–5. However, the orientation of the deflector 83*b* of FIG. 9 is offset from the orientation of the deflector 83 of FIG. 5. This results in a passage formed in an opening 86*b* between the outer side surface 82*b* of the deflector 83*b* and the housing 60*b* being shorter than a passage formed by the opening 88*b*. This facilitates the flow of granular material from the container 34*b* through the passage 86*b* to the lower portion 98*b* of the mixing chamber 66*b*.

Conclusion

In view of the foregoing description, it is apparent that the present invention provides a new and improved apparatus for use in applying granular material, such as sand, to a rail adjacent to a wheel of a train. The apparatus includes a container 34 which holds a supply of granular material. The granular material flows from the container 34 to a mixing chamber 66. Air is conducted to the mixing chamber 66 through an air inlet 72. Air and granular material are conducted from the mixing chamber 66 through an outlet 76.

A venturi 140 may advantageously be provided in the air and granular material outlet 76 to induce an upward flow of granular material from a lower portion 98 of the mixing chamber 66 toward the air and granular material outlet. A deflector 83 may be provided to deflect a flow of granular material entering the mixing chamber 66 away from a flow of air from the air inlet 72. A valve 102 may be provided to facilitate controlling the rate of flow of air into the mixing chamber. To facilitate assembly and maintenance, it may be desired to have the valve 102, the deflector 83, and the venturi 170 form a separate assembly 168 which can be positioned in the housing 60 for the mixing chamber 66.

In order to promote the application of granular material at a desired rate to the rail 22, the rate of flow of air to the mixing chamber 66 may be varied as a function of variations in speed of the train 10. This may be accomplished by effecting operation of a compressor drive motor 110 or 112 at a speed which is a function of the speed of the train. This results in the compressor 104 or 106 supplying air to the mixing chamber 66 at a flow rate which varies as a function of variations in the speed of the train. If desired, the valve 102 may be actuated to vary the rate of flow of air to the mixing chamber 66.

The present invention has many different features. Each of these features may be used separately or in combination with other features of the invention. If desired, one or more of the features of the present invention may be combined with features of the prior art. For example, the deflector 83 may be used without the valve assembly 102 and venturi 140. As an additional example, the granular material injection system 30 may be used with or without the electronic control unit 118 and wheel speed sensor 130.

Having described the invention, the following is claimed:

1. An apparatus for use in applying granular material to a rail adjacent to a wheel of a train, said apparatus comprising a housing adapted to be connected with a portion of the train and with a granular material supply, a mixing chamber disposed in said housing, said mixing chamber having an upper portion through which granular material from the granular material supply enters said mixing chamber and a lower portion in which granular material accumulates, an air inlet which directs a flow of air into the mixing chamber at a location above the lower portion of the mixing chamber, and a venturi having an inlet disposed above the lower portion of said mixing chamber, said venturi having an outlet which is connected in fluid communication with a nozzle which directs a flow of the granular material toward the rail during the flow of air from said air inlet to the mixing chamber and from the mixing chamber to said inlet to said venturi, said venturi cooperating with the flow of air from said air inlet to induce an upward flow of the granular material from the lower portion of the mixing chamber into said inlet to said venturi.

2. An apparatus as set forth in claim 1 further including a deflector which is disposed between opposite sides of said mixing chamber and is disposed above a path of flow of air from said air inlet to said inlet to said venturi to deflect granular material entering the mixing chamber away from the path of flow of air from said air inlet to said inlet to said venturi.

3. An apparatus as set forth in claim 2 wherein said deflector cooperates with said housing to at least partially define first and second openings, said deflector being effective to deflect granular material toward the first and second openings.

4. An apparatus as set forth in claim 2 wherein said deflector has an arcuate side surface which is formed as a portion of a cylinder having a longitudinal central axis extending parallel to the path of flow of air from said air inlet to said inlet to said venturi.

5. An apparatus as set forth in claim 1 wherein said inlet to said venturi has a converging configuration, said venturi having an outlet with a diverging configuration.

6. An apparatus as set forth in claim 1 further including a valve member disposed at said air inlet, said valve member being movable relative to said housing to vary size of an opening through which air flows from said air inlet toward said venturi.

7. An apparatus as set forth in claim 1 further including means for varying a rate of flow of air from said air inlet as a function of variations in speed of the train.

8. An apparatus as set forth in claim 1 further including a compressor connected in fluid communication with said air inlet and means for varying an operating speed of said compressor as a function of variations in speed of the train.

9. An apparatus as set forth in claim 1 further including a valve member disposed at said air inlet and means for moving said valve member to vary the size of an opening through which air flows from said air inlet toward said venturi as a function of variations in speed of the train.

10. An apparatus as set forth in claim 1 further including a heater mounted in said housing beneath the lower portion of said mixing chamber to retard freezing of granular material in the lower portion of said mixing chamber.

11. An apparatus as set forth in claim 1 further including first and second compressors connected in fluid communication with said air inlet and first and second motors connected with said first and second compressors to drive said first and second compressors to supply air which flows from said air inlet across said mixing chamber to said inlet to said venturi.

12. An apparatus as set forth in claim 1 further including a compressor connected in fluid communication with said air inlet and operable to supply air at a pressure of thirty pounds per square inch or less to said air inlet.

13. An apparatus as set forth in claim 1 further including a conduit connecting the outlet from said venturi in fluid communication with said nozzle, and a source of air under pressure connected in fluid communication with said air inlet and with said conduit.

14. An apparatus as set forth in claim 13 wherein air at a first pressure is conducted from said source of air under pressure to said air inlet and air at a second pressure is conducted from said source of air under pressure to said conduit, said second pressure being less than said first pressure.

15. An apparatus as set forth in claim 1 further including a deflector which is disposed in said mixing chamber and has an outer side surface which deflects a flow of granular material away from a path of flow of air from said air inlet to said venturi, said deflector cooperating with said housing to at least partially define first and second paths along which granular material flows from the upper portion of the mixing chamber to the lower portion of the mixing chamber, said first and second paths having substantially equal lengths along the outer side surface of said deflector.

16. An apparatus as set forth in claim 1 further including a deflector which is disposed in said mixing chamber and has an outer side surface which deflects a flow of granular material away from a path of flow of air from said air inlet to said venturi, said deflector cooperating with said housing to at least partially define first and second paths along which granular material flows from the upper portion of the mixing chamber to the lower portion of the mixing chamber, said first and second paths having substantially different lengths along the outer side surface of said deflector.

17. An apparatus as set forth in claim 1 further including a deflector which is disposed in said mixing chamber and has an outer side surface which deflects a flow of granular material away from a path of flow of air from said air inlet to said venturi, said deflector at least partially defines an opening through which the upward flow of granular material moves from the lower portion of the mixing chamber into said inlet to said venturi.

18. An apparatus as set forth in claim 17 wherein the opening which is at least partially defined by said deflector has a rectangular cross sectional configuration.

19. An apparatus as set forth in claim 17 wherein the opening which is at least partially defined by said deflector has a circular cross sectional configuration.

20. An apparatus for use in applying granular material to a rail adjacent to a wheel of a train, said apparatus comprising a housing adapted to be connected with the train and with a granular material supply, a mixing chamber disposed in said housing, said mixing chamber having an upper portion through which the granular material from the granular material supply enters said mixing chamber and a lower portion in which the granular material accumulates, an air inlet which directs a flow of air into the mixing chamber at a location above the lower portion of the mixing chamber, an air and granular material outlet from said mixing chamber disposed above the lower portion of said mixing chamber on a side of said mixing chamber opposite from said air inlet, said air and granular material outlet being connected in fluid communication with a nozzle which directs the flow of air and the granular material toward the rail during the flow of air from said air inlet to said air and granular material outlet, and a deflector which extends between opposite sides of said housing and is disposed above a path of flow of the air from said air inlet to said air and granular material outlet, said deflector being effective to deflect the granular material away from the path of flow of the air from said air inlet to said air and granular material outlet.

21. An apparatus as set forth in claim 20 further including a venturi through which air and granular material flows at said outlet from said mixing chamber.

22. An apparatus as set forth in claim 20 wherein said deflector cooperates with said housing to at least partially define first and second openings, said deflector being effective to deflect granular material toward the first and second openings.

23. An apparatus as set forth in claim 20 wherein said deflector has an arcuate side surface which is formed as a portion of a cylinder having a longitudinal central axis extending parallel to the path of flow of air from said air inlet to said air and granular material outlet.

24. An apparatus as set forth in claim 20 further including a conduit connecting said air and granular material outlet in fluid communication with said nozzle, and a source of air under pressure connected in fluid communication with said air inlet and with said conduit.

25. An apparatus as set forth in claim 20 further including a deflector which is disposed above a path of flow of air from said air inlet to said air and granular material outlet to defied granular material entering the mixing chamber away from the path of flow of air from said air inlet to said air and granular material outlet.

26. An apparatus as set forth in claim 25 wherein said deflector has an arcuate side surface which is formed as a portion of a cylinder having a longitudinal central axis extending parallel to the path of flow of air from said air inlet to said and granular material outlet.

27. An apparatus as set forth in claim 25 wherein said deflector cooperates with said housing to at least partially define an opening through which granular material flows toward the lower portion of the mixing chamber.

28. An apparatus for use in applying granular material to a rail adjacent to a wheel of a train, said apparatus comprising an insert having first and second end portions interconnected by a deflector portion, a valve member disposed in said first end portion of said insert, a venturi disposed in said second end portion of said insert, said valve member and venturi being disposed in a coaxial relationship to enable a flow of air past said valve member to move along said deflector portion of said insert into said venturi, said deflector portion of said insert having an outer side surface which deflects a flow of the granular material away from a path of flow of air between said valve member and said venturi, said deflector portion of said insert at least partially defining an opening on a side of said insert opposite from said outer side surface on said deflector portion of said insert, said flow of air between said valve member and said venturi being effective to induce a flow of the granular material through the opening in said insert into said venturi, said venturi having an outlet through which a flow of air and granular material is conducted to the rail at a location adjacent to the wheel of the train.

29. An apparatus as set forth in claim 28 wherein said deflector portion of said insert has an arcuate side surface which is formed as a portion of a cylinder having a longitudinal central axis extending parallel to the path of flow of air from said valve member to said venturi.

30. An apparatus as set forth in claim 28 wherein said first end portion of said insert has an annular flange which is engagable with a housing and said second end portion of said insert has an external thread convolution which is engagable by an internally threaded member to enable the housing to be held between said flange and the internally threaded member.

31. An apparatus for use in applying granular material to a rail adjacent to a wheel of a train, said apparatus comprising a housing adapted to be connected with the train and with a granular material supply, a mixing chamber disposed in said housing, an insert connected with said housing, said insert having first and second end portions and a deflector portion extending between said first and second end portions of said insert, said first end portion of said insert being supported by said housing and having an air inlet through which air flows into the mixing chamber in said housing, said second end portion of said insert being supported by said housing and having an air and granular material outlet through which air and the granular material flow from the mixing chamber in said housing, said deflector portion of said insert having an outer surface which deflects granular material flow to the mixing chamber away from a path of flow of air between said air inlet and said air and granular material outlet.

32. An apparatus as set forth in claim 31 further including a valve member disposed in said first end portion of said insert to control a flow of air through said air inlet and a venturi disposed in said second end portion of said insert to accelerate a flow of air and induce a flow of granular material in the mixing chamber toward said air and granular material outlet.

33. An apparatus as set forth in claim 31 further including a compressor connected in fluid communication with said air inlet, a motor connected with said compressor and operable to drive said compressor, a sensor which is operable to provide an output which is a function of train speed, and a controller connected with said motor and said sensor, said controller being operable to effect operation of said motor at a speed which is a function of the speed of the train to effect operation of said compressor at a speed which is a function of the speed of operation of the train.

34. an apparatus for use in applying granular material to a rail adjacent to a wheel of a train, said apparatus comprising a housing adapted to be connected with a portion of the train and with a granular material supply, a mixing chamber disposed in said housing, said mixing chamber having an upper portion through which granular material from the granular material supply enters said mixing chamber and a lower portion in which the granular material accumulates, an air inlet which directs a flow of air into the mixing chamber at a location above the lower portion of the mixing chamber, said air inlet being connected in fluid communication with a source of air at thirty rounds per square inch or less, a venturi having a converging inlet disposed above the lower portion of said mixing chamber, said venturi having a diverging outlet which is connected in fluid communication with a nozzle which directs a flow of the granular material toward the rail during a flow of air from said air inlet to the mixing chamber and from the mixing chamber to said inlet to said venturi, said venturi cooperating with the flow of air from said air inlet to induce an upward flow of the granular material from the lower portion of the mixing chamber into said inlet to said venturi, and a deflector which is disposed between opposite sides of said mixing chamber and is disposed above a path of flow of air from said air inlet to said inlet to said venturi to deflect the granular material entering the mixing chamber away from the path of flow of air from said air inlet to said inlet to said venturi, said deflector has an arcuate side surface which is formed as a portion of a cylinder having a longitudinal central axis extending parallel to the path of flow of air from said air inlet to said inlet to said venturi, said arcuate side surface of said deflector cooperates with said housing to at least partially define first and second paths along which the granular material from the upper portion of said mixing chamber moves to the lower portion of said mixing chamber, said deflector having an opening through which the upward flow of the granular material moves from the lower portion of the mixing chamber into said inlet to said venturi.

* * * * *

UNITED STATES PATENT AND TRADEMARK OFFICE

CERTIFICATE OF CORRECTION

PATENT NO. : 6,976,713 B2
APPLICATION NO. : 10/368105
DATED : December 20, 2005
INVENTOR(S) : Tom Kish and Peter Pietrowski It is certified that error appears in the above-identified patent and that said Letters Patent is hereby corrected as shown below:

Column 19,
Line 2, after "said" insert -- air --.

Signed and Sealed this

Twenty-seventh Day of June, 2006

JON W. DUDAS
*Director of the United States Patent and Trademark Office*